US008210865B2

(12) United States Patent
Hayashi

(10) Patent No.: US 8,210,865 B2
(45) Date of Patent: Jul. 3, 2012

(54) TERMINAL BLOCK AND METHOD OF ASSEMBLING THE SAME

(75) Inventor: Tatsuya Hayashi, Higashine (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/132,144

(22) PCT Filed: Nov. 20, 2009

(86) PCT No.: PCT/US2009/065307

§ 371 (c)(1),
(2), (4) Date: Jun. 1, 2011

(87) PCT Pub. No.: WO2010/074858

PCT Pub. Date: Jul. 1, 2010

(65) Prior Publication Data

US 2011/0244708 A1 Oct. 6, 2011

(30) Foreign Application Priority Data

Dec. 25, 2008 (JP) ..... 2008-331276

(51) Int. Cl.
*H01R 4/24* (2006.01)

(52) U.S. Cl. ..... 439/409

(58) Field of Classification Search ..... 439/409, 439/410, 729, 819, 822
See application file for complete search history.

(56) References Cited

U.S. PATENT DOCUMENTS 2,230,277 A * 2/1941 Volker et al. ..... 200/302.1
2,501,284 A * 3/1950 Miller et al. ..... 174/395
2,673,334 A * 3/1954 Julian et al. ..... 439/353
3,005,176 A * 10/1961 Berg ..... 439/369
3,242,286 A * 3/1966 Heilman et al. ..... 335/46
3,517,355 A * 6/1970 Cole ..... 335/16
3,588,761 A * 6/1971 Heft et al. ..... 335/16
4,536,726 A * 8/1985 Hideo ..... 335/23

(Continued)

FOREIGN PATENT DOCUMENTS

JP 61-136431 6/1986
JP 3-147216 6/1991
JP 7-183059 7/1995

OTHER PUBLICATIONS

International Search Report for PCT/US2009/065307, pp. 3, Jul. 2010.

*Primary Examiner* — Tulsidas C Patel
*Assistant Examiner* — Vladimir Imas
(74) *Attorney, Agent, or Firm* — Robert S. Moshrefzadeh

(57) ABSTRACT

To provide a terminal block having a structure for facilitating the mounting operation of a coil spring to the terminal block, and a method for assembling the terminal block. A spring supporting part (25*a*) has a supporting surface (251*a*) in which one end of a coil spring (5*a*) contacts, and a spring end holding portion (252*a*) for preventing the end of the coil spring contacting supporting surface (251*a*) from displacing in the radial direction of the coil spring. Spring end holding portion (252*a*) extends form supporting surface (251*a*) and is arranged at a part of the periphery of supporting surface (251*a*), such that spring end holding portion (252*a*) does not block a slit (27*a*). The width of slit (27*a*) is smaller than an outer diameter of coil spring (5*a*), and the length of slit (27*a*) is preferably equal to or larger than the radius of coil spring (5*a*).

4 Claims, 7 Drawing Sheets

U.S. PATENT DOCUMENTS 5,089,735 A * 2/1992 Sawaguchi et al. ..... 310/88
5,162,765 A * 11/1992 DiVincenzo et al. ..... 335/175
5,810,625 A * 9/1998 Klein et al. ..... 439/709
6,341,989 B1 * 1/2002 Jaag ..... 439/725
6,595,809 B2 * 7/2003 Matsumoto et al. ..... 439/835
6,666,707 B2 * 12/2003 Moret Codina ..... 439/441
8,062,077 B2 * 11/2011 Hayashi et al. ..... 439/725
2003/0008569 A1 * 1/2003 Matsumoto et al. ..... 439/835

* cited by examiner

TERMINAL BLOCK AND METHOD OF ASSEMBLING THE SAME

CROSS REFERENCE TO RELATED APPLICATIONS

This application is a national stage filing under 35 U.S.C. 371 of PCT/US2009/065307, filed 20 Nov. 2009, which claims priority to Japanese Application No. 2008-331276 filed 25 Dec. 2008, the disclosure of which is incorporated by reference in its/their entirety herein.

TECHNICAL FIELD

The present invention relates to a terminal block such as a push-type terminal block having a lever and a method for assembling the terminal block.

BACKGROUND

A so-called push-type terminal block has a push-type lever, an insertion hole and a connecting terminal therein. A cable conductor or a lead terminal attached to an end of a cable may be inserted into the insertion hole and connected to the connecting terminal. Such a push-type terminal block is, for example, used on the back side of an audio instrument and, in many cases, a plurality of the terminal blocks are aligned. For example, Japanese Unexamined Patent Publication (Kokai) No. 7-183059 describes that "When a lead "A" is connected to a first clamp portion 20, as shown in FIG. 3(*b*), a lever 3 is inclined on a seat member 2 about a rear edge 15*a* of a pressure contact portion 15 in order to raise a sliding shaft 4. Therefore, first and second holes 5 and 13 are aligned and lead "A" may be inserted into holes 5 and 13".

A terminal block, having a movable portion such as a lever, usually has a coil spring for biasing the lever in a certain direction. For example, Japanese Unexamined Patent Publication (Kokai) No. 3-147216 describes that "As shown in FIG. 3(イ), a spring stopper plate 11 has a raised portion 22 on which a rear end of a coil spring 8 is hooked, and then, as shown in FIG. 3(ロ), spring stopper plate 11 is bent so that the plate closes a spring insertion hole 9 of a case 1, whereby raised portion 22 pushes coil spring 8 forward".

Japanese Unexamined Patent Publication (Kokai) No. 61-136431 describes that "As shown in FIG. 3, when a return spring 15 is assembled in a direction C, return spring 15 may be smoothly assembled without being jammed in a gap D, by means of a projecting column 21 arranged in a containing portion 14".

In recent years, a terminal block such as a push-type terminal block is required to be more compact because an apparatus including the terminal block becomes downsized and complicated. Therefore, each component constituting the terminal block is inevitably required to be downsized. Concretely, a push lever for opening an insertion hole of each terminal and a coil spring which biases the push lever in the anti-push direction are required to be more compact. On the other hand, the lever and the coil spring are usually assembled manually, therefore, such compact lever or coil spring makes such a manual working troublesome. In particular, the coil spring is usually compressed when it is positioned in a housing and engaged with the lever. The compressed spring may be undesirably apart from a hand of an operator due to a repulsive force of the spring.

SUMMARY

The present invention thus provides a terminal block having a structure by which a coil spring may be easily assembled in the terminal block, and a method of assembling the terminal block.

In order to achieve the object of the invention described above, one aspect of the present invention provides a terminal block comprising: a housing; at least one lever member movably arranged on the housing; at least one coil spring positioned in the housing, the at least one coil spring being configured to bias the at least one lever member in a certain direction; a spring supporting part configured to support one end of the coil spring; an opening formed in the housing for inserting the coil spring into the housing; and a slit communicated with the opening of the housing, the slit extending in at least a portion of the spring supporting part and having the width which is smaller than an outer diameter of the coil spring.

Another aspect of the present invention provides a method for assembling a terminal block, the method comprising the steps of: providing a housing having at least one lever member movably arranged on the housing; providing a jig having a holding member capable of holding one end of a coil spring which biases the at least one lever member in a certain direction in the housing; engaging one end of the coil spring with the holding member of the jig; inserting the coil spring into the housing through an opening formed in the housing; engaging the other end of the coil spring with a portion of the lever member in the housing; compressing the coil spring by pushing the jig into the housing; moving the jig such that the holding member is positioned in a slit formed in the housing while the coil spring is compressed, the slit being communicated with the opening of the housing, the slit extending in at least a portion of a spring supporting part configured of the housing to support the one end of the coil spring, and having the width which is smaller than an outer diameter of the coil spring; and drawing out the jig from the housing while the holding member of the jig is positioned in the slit such that the one end of the coil spring contacts the spring supporting part of the housing.

According to the present invention, even when a terminal block is downsized, a coil spring which biases a lever may be easily and assuredly attached to or detached from the terminal block.

BRIEF DESCRIPTION OF THE DRAWINGS

FIG. 5B is a cross sectional view along B-B line of a housing of terminal block of FIG. 1.

FIG. 13B is a cross sectional view along B-B line of a housing of a terminal block according to a modification of the terminal block as shown in FIG. 1.

DETAILED DESCRIPTION

Figure 1:
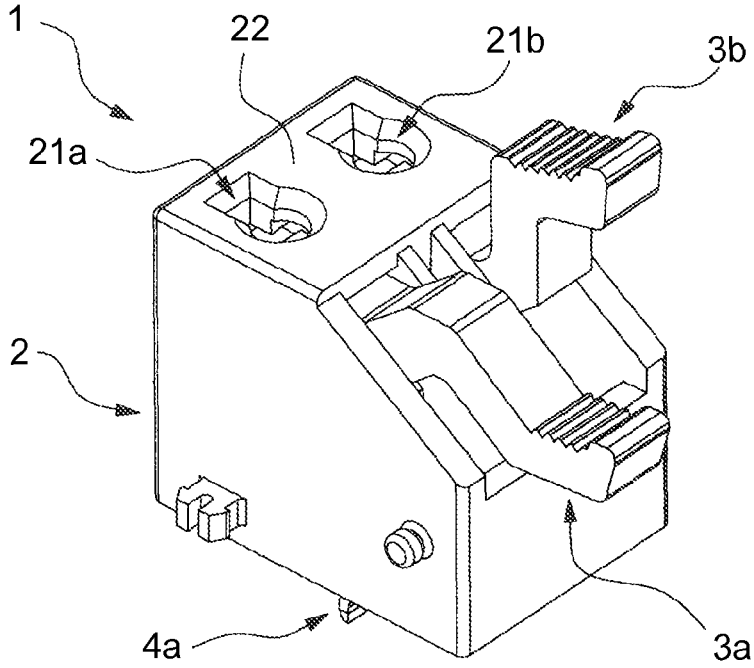
FIG. 1 A perspective view showing a push-type terminal block according to one embodiment of the present invention.
Figure 2:
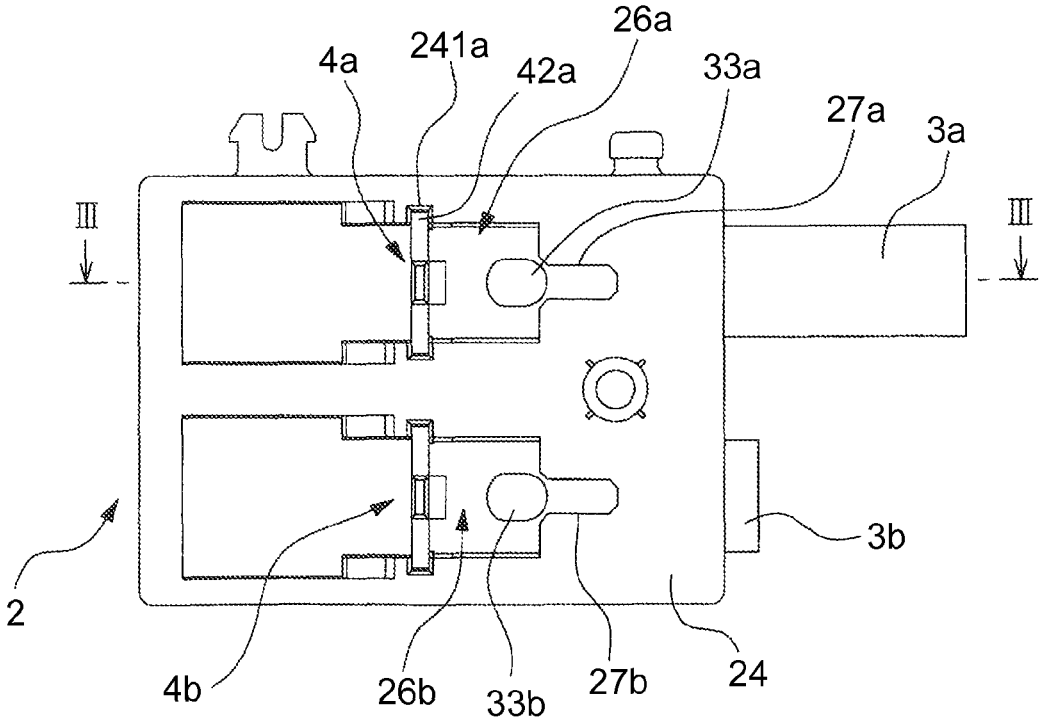
FIG. 2 A bottom view of the terminal block of FIG. 1.
Figure 3:
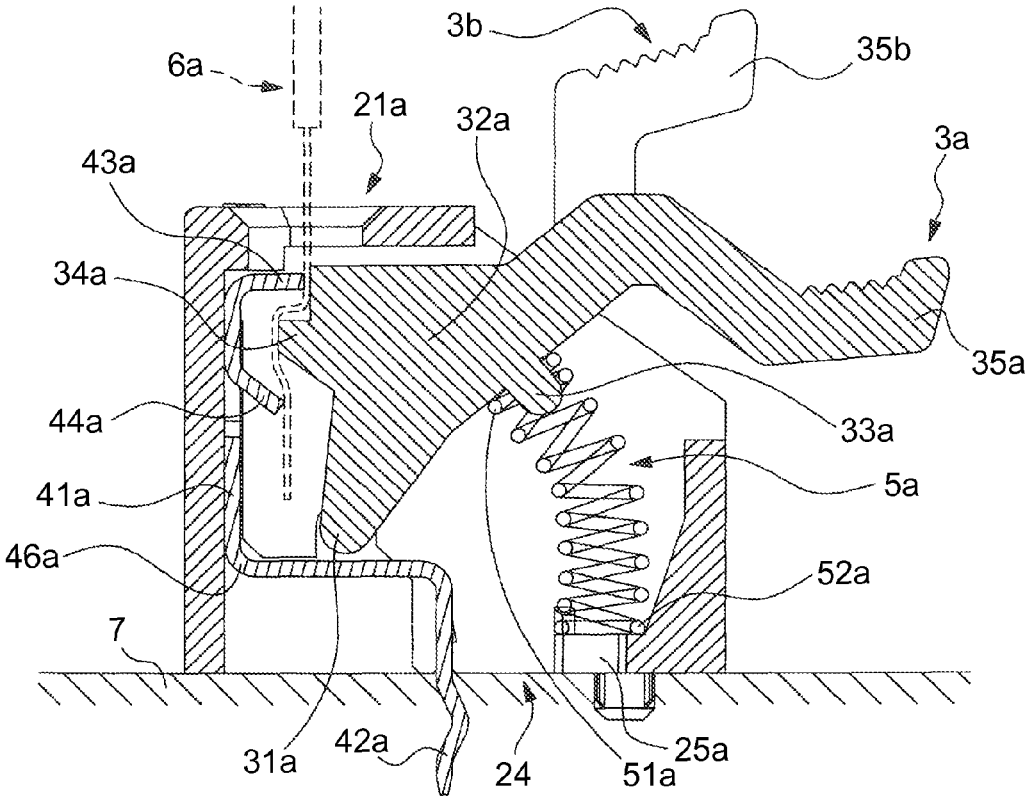
FIG. 3 A cross sectional view along III-III line of FIG. 2.

FIG. 1 is a perspective view of a preferable embodiment of a push-type terminal block 1 (hereinafter, merely referred to as "terminal block"). FIG. 2 is a view showing terminal block 1, and FIG. 3 is a cross sectional view along a III-III line of FIG. 2. Terminal block 1 has a housing 2, first and lever members 3*a* and 3*b* movably arranged on housing 2, first and second connecting terminals 4*a* and 4*b* made from conductive material (as for second terminal 4*b*, a part of which is shown in FIG. 2), and first and second biasing members or coil springs which bias first and second lever members 3*a* and 3*b*, respectively (only first biasing member 5*a* is shown in FIG. 3). Housing 2 may be made from arbitrary material such as metal or resin. As shown in FIG. 1, housing 2 has insertion holes 21*a* and 21*b* at a top surface 22 thereof, through which a cable conductor or a lead terminal attached to an end of a cable to be connected to each connecting terminal in the housing (hereinafter, merely referred to as "lead") ma be inserted.

As shown in FIG. 3, first connecting terminal 4*a* may be made by bending and/or punching a metal plate such as a copper sheet. First connecting terminal 4*a* has generally a L-shape provided with a back side portion 41*a* and a bent leg portion 42*a*. By engaging leg portion 42*a* with a groove portion 241*a* (see FIG. 2) formed on a bottom part 24 of housing 2, first connecting terminal 4*a* may be fixed to housing 2. Connecting terminal 4*a* further has two projections 43*a* and 44*a* for contacting a first lead 6*a* (shown in FIG. 3 by a dashed line) inserted into through hole 21*a*. Projections 43*a*, 44*a* may be formed by bending and/or punching a part of the metal plate and are separated from each other by a certain distance in the longitudinal direction of first lead 6*a*. Leg portion 42*a* of terminal 4*a* projects from bottom part 24 of housing 2 (or a housing surface connected to a substrate 7 as schematically shown in FIG. 3), and may be electrically connected to a through hole (not shown) formed on substrate 7 by soldering, etc. Alternatively, leg portion 42*a* of the connecting terminal may be bent such that the leg portion extends parallel to the substrate for performing surface mounting, and the leg portion may be electrically connected to a conductive part (or a land) on the substrate by soldering, etc. The other connecting terminal 4*b* may have the same configuration as first connecting terminal 4*a*.

As shown in FIG. 3, first lever member 3*a* is configured to pivot about a support shaft 31 a thereof. Support shaft 31 a is positioned near and inside a bend portion 46*a* of connecting terminal 4*a* having generally a L-shape. First lever member 3*a* has a body part 32*a* extending from support shaft 31*a* and opposite to terminal 4*a*, and a protrusion 33*a* formed on body part 32*a* and apart from shaft 31*a* in the longitudinal direction of the lever member. First biasing member 5*a* such as a coil spring has one end 51*a* engaged with protrusion 33*a* and opposite end 52*a* received in a spring supporting part 25*a* formed on bottom part 24 of housing 2. Coil spring 5*a* biases lever member 3*a* (upward in FIG. 3) such that a wedge part 34*a* of lever member 3*a*, formed near two projections 43*a*, 44*a* of first connecting terminal 4*a*, is positioned between the two projections. The expression "positioned in the housing" or the like herein means not only that the coil spring is completely contained in the housing, but also that only a part of the coil spring is positioned within the housing. For example, a part of the coil spring may project from a surface of the housing, otherwise, the coil spring may not be substantially covered by the housing since the area of wall portions of the housing is very small (in other words, the housing has many openings).

Second lever member 3*b* and a second coil spring (not shown) which biases second lever member 3*b* may have the same constitutions as first lever member 3*a* and first coil spring 5*a*, respectively. In the illustrated embodiment, in order to prevent an operator from undesirably contact second lever member 3*b* when the operator should contact only first lever member 3*a*, the positions of an operating part 35*a* of first lever member 3*a* and an operating part 35*b* of second lever member 3*b* are different when the operator does not contact both operating parts, as shown in FIG. 3.

Figure 4:
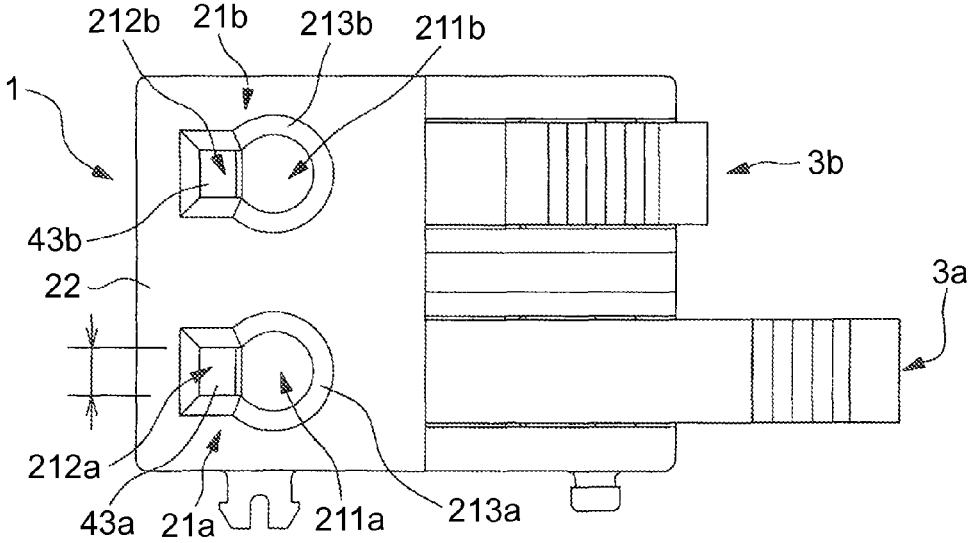
FIG. 4 A top view of the terminal block of FIG. 1.

FIG. 4 is a top view of terminal block 1. Insertion holes 21*a* and 21*b* have cable through parts 211*a* and 211*b*, probe through parts 212*a* and 212*b* communicated with the cable through parts, respectively. Cable through parts 211*a* and 212*b* are generally circular through holes having inclined surfaces 213*a* and 213*b*, respectively, at one end thereof near top surface 22. The diameter of each cable through part is somewhat larger than the outer diameter of the cable to be inserted in to the cable through part. On the other hand, the probe through parts are generally rectangular holes each having the width W which is smaller than the diameter of the cable through part. The width W may be smaller than the diameter of a conductor of the cable inserted into the through hole. Within housing 2 just below insertion holes 21*a* and 21*b*, projections 43*a* and 43*b* of connecting terminals 4*a* and 4*b* are positioned. Viewed from the top surface of housing 2, the front end of each projection is positioned generally on the circumference of the circular through hole.

While the cable is inserted in to the through hole, a probe of a tester or the like may be inserted into each of probe through parts 212*a* and 212*b* and connected to the projection of the connecting terminal, whereby a conductive state between terminal block 1 and the cable connected to terminal block 1 may be examined. Since the width W is smaller than the diameter of the cable through part, the front end of the cable is not likely to be accidentally inserted into the probe through part when the cable should be inserted into the cable through part. Therefore, the workability of inserting the cable may be enhanced. If the width W is smaller than the diameter of the conductor of the cable, the false insertion of the cable may be more effectively prevented. Further, since the cable through part is visually larger than the probe through part, the operator can easily identify the cable through part from the probe through parts.

As shown in FIG. 2, an opening 26*a* through which terminal 4*a* and coil spring 5*a* are inserted so as to position them in housing 2, and an opening 26*b* through which terminal 4*b* and a coil spring (not shown) are inserted so as to position them in housing 2, are formed at bottom part 24 of housing 2. Further, a slit or a concave portion 27*a* which is communicated with opening 26*a* and generally straightly extends in spring supporting part 25*a*, and a slit or a concave portion 27*b* which is communicated with opening 26*b* and generally straightly extends in spring supporting part 25*b*, are formed bottom part 24. Although slit 27*a* generally straightly extends over the center of spring supporting part 25*a*, it is sufficient that the front end of slit 27*a* reaches spring supporting part 25*a*. In addition, slit 27*a* may not straightly extend, for example, may extend like an L-shape or an S-shape.

Figure 5:
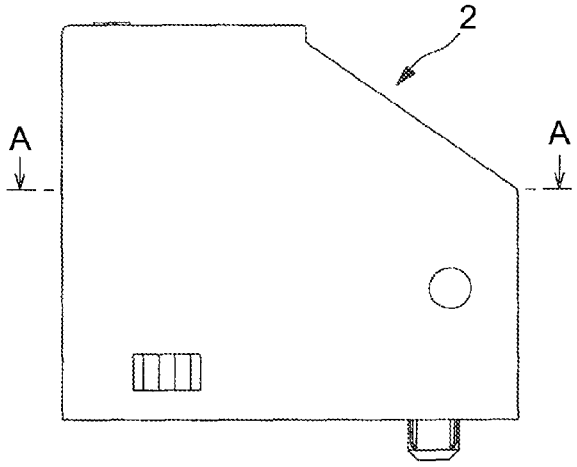
FIGS. 5-5B FIG. 5 is a side view.
Figure 5A:
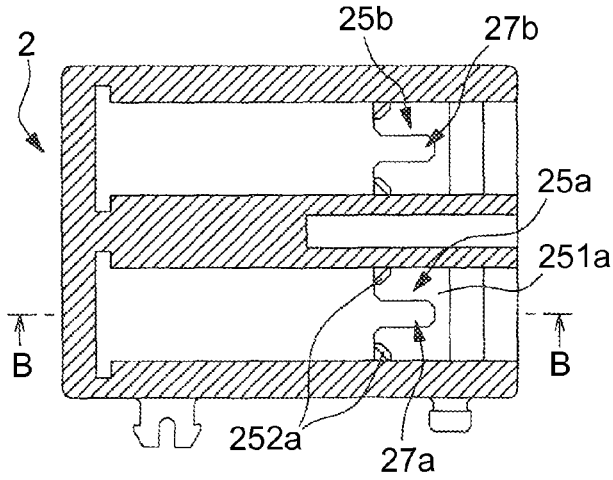
FIG. 5A is a cross sectional view along A-A line of the side view.
Figure 5B:
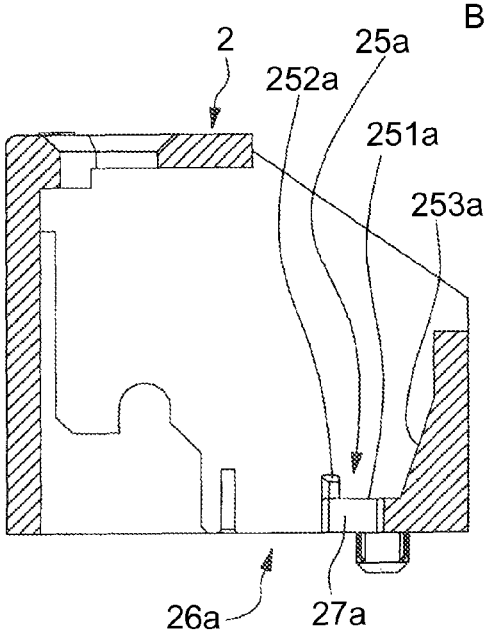

FIGS. 5, 5A, and 5B show a part drawing of housing 2 and two cross sectional views thereof. Spring supporting part 25*a* has a supporting surface 251*a* which contacts one end 52*a* of coil spring 5*a* (FIG. 3), and a spring end holding portion 252*a* which holds coil spring end 52*a* such that the end does not offset in the radial direction of the coil spring. For example, spring end holding portion 252*a* generally vertically extends from supporting surface 251*a* and arranged at a part of the periphery (two positions in the illustrated embodiment) of supporting surface 251 a such that spring end holding portion 252*a* does not block slit 27*a*. The width of slit 27*a* is smaller than the outer diameter of coil spring 5*a*, and the length of slit 27*a* is preferably equal to or larger than the radius of coil spring 5*a*. Since spring supporting part 25*b* and slit 27*b* may be the same as spring supporting part 25*a* and slit 27*a*, respectively, the detailed explanation thereof is omitted. Spring supporting part 25*a* may have a wall portion 253*a* adjacent to supporting surface 251*a* and positioned generally opposite to slit 27*a*, whereby wall portion 253*a* may also have the holding function for the coil spring end. As an alternative to spring end holding portion 252*a* as shown in FIG. 5B, a protrusion (not shown), which projects from generally the center of supporting surface 251*a* and have the dimension smaller than the inner dimension of coil spring 5*a* (i.e., the protrusion may be inserted into the end of the coil spring), may be arranged.

Next, with reference to FIGS. 6 to 12, the procedure for assembling the coil spring with the terminal block of the invention will be explained. Although the explanation below relates to coil spring 5*a* used for biasing first lever 3*a*, the same explanation may be applied to the coil spring used for biasing second lever 3*b*.

Figure 6:
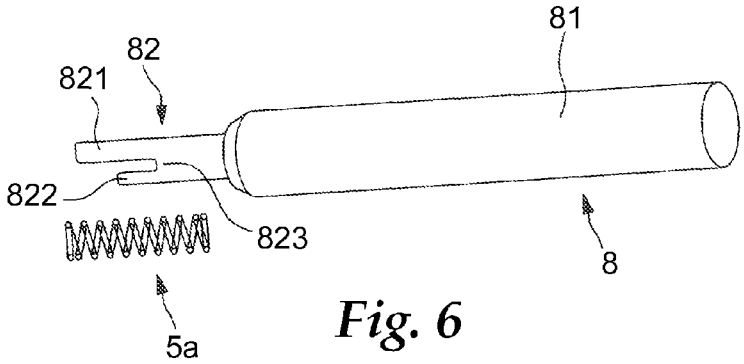
FIG. 6 A view showing a coil spring and an embodiment of a jig for mounting the coil spring to the terminal block.

First, as shown in FIG. 6, a jig 8, used for mounting coil spring 5*a* in housing 2 of terminal block 1, is provided. Jig 8 has a shaft part 81, preferably having a rod-shape, configured to be gripped by an operator, and a holding part 82 attached to one end of shaft part 81 configured to hold coil spring 5*a*. Holding part 82 is a plate member having generally U-shape or J-shape. In particular, holding part 82 has a first projection 821 having the width smaller than the inner diameter of coil spring 5*a* and the length smaller than the length of coil spring 5*a*, a second projection 822 positioned apart from first projection 821 by at least a wire diameter of coil spring 5*a*, and a bottom portion 823, arranged between the first and second projections, configured to contact one end 52*a* of coil spring 5*a* when first projection 821 is inserted into coil spring 5*a*. The projecting length of second projection 822 is preferably smaller than the length of first projection 821, in view of operability of the procedure as described below. Holding part 82 is totally constituted by a member having the thickness smaller than the width of slit 27*a*. In addition, as second projection 822 is not essential, holding part 82 may have generally a rod-shape.

Figure 7:
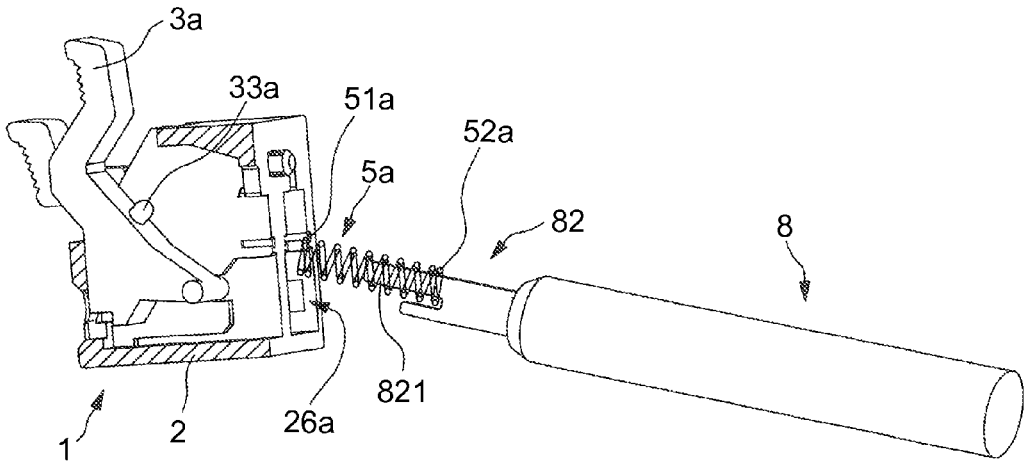
FIG. 7 A view showing the state that the jig holding the coil spring is moved close to an opening in the bottom of the housing of the terminal block.

Then, as shown in FIG. 7, while coil spring 5*a* is held by holding part 82 of jig 8 (concretely, projection 821 of jig 8 is inserted into coil spring 5*a*), the operator moves holding part 82 of jig 8 close to bottom opening 26 of housing 2 of terminal block 1.

Figure 8:
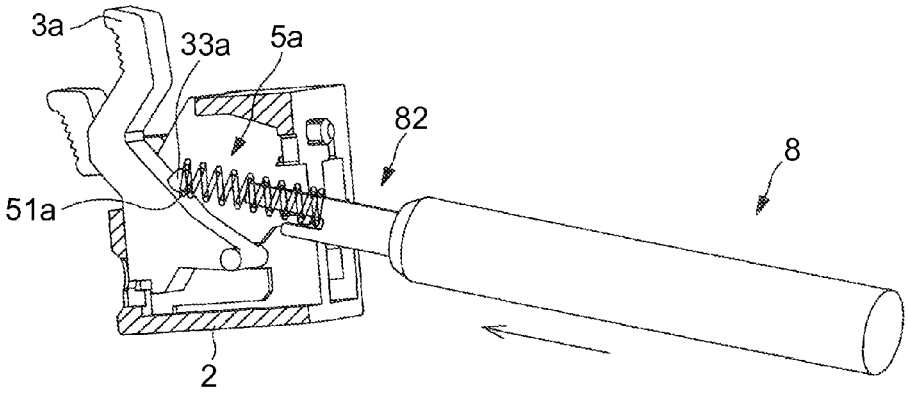
FIG. 8 A view showing the state that the jig is inserted into the bottom opening so as to engage one end of the coil with a protrusion of a lever member.

Further, as shown in FIG. 8, coil spring 5*a* is inserted into opening 26 with holding part 82, until one end 51*a* of coil spring 5*a* engages protrusion 33*a* of first push lever 3*a*. Although the shape of protrusion 33*a* is not limited to a dome or hemisphere as illustrated, the shape of protrusion 33*a* is preferably determined so that the position of coil spring end 51 a is not substantially changed while the coil spring engages the protrusion.

Alternatively, lever member 3*a* may have a recess at the position of protrusion 33*a*, whereby the coil spring end may be inserted in to the recess.

Figure 9:
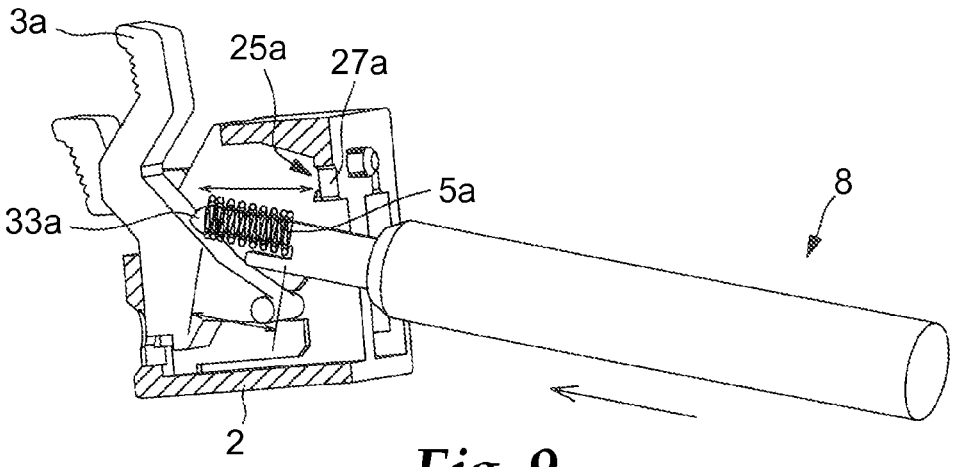
FIG. 9 A view showing the state that the jig is further inserted so as to compress the coil spring.

Next, as shown in FIG. 9, jig 8 is further pushed from the state of FIG. 8 so that coil spring 5*a* is compressed. At this point, jig 8 is pushed at least until a length L1 of the compressed coil spring becomes smaller than a distance L2 between spring supporting part 25*a* and protrusion 33*a*.

Figure 10:
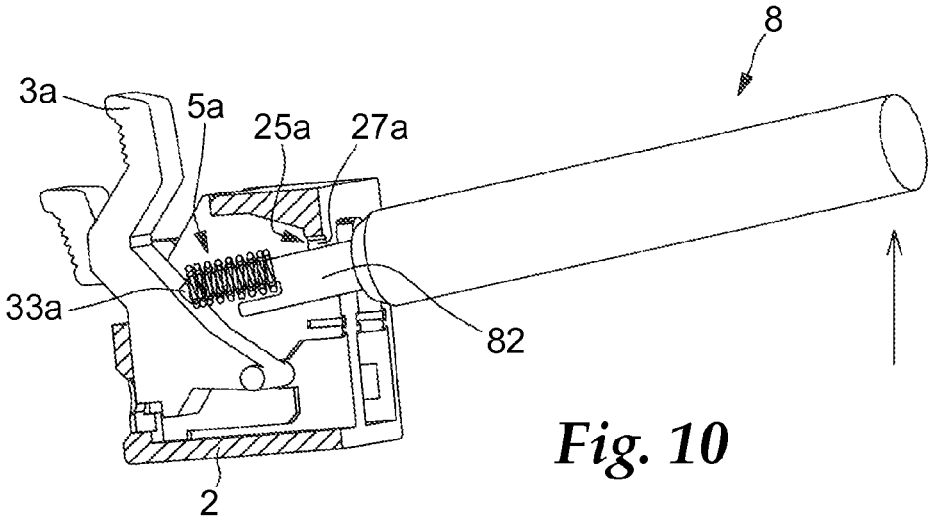
FIG. 10 A view showing the state that jig is pivoted so that the jig enters a slit formed in the bottom of the housing while keeping the coil spring compressed.

Then, as shown in FIG. 10, while keeping coil spring 5*a* compressed, jig 8 is pivoted about protrusion 33*a* toward spring supporting part 25*a*. At this point, holding part 82 of jig 8 is inserted into slit 27*a* formed at the bottom of housing 2.

Figure 11:
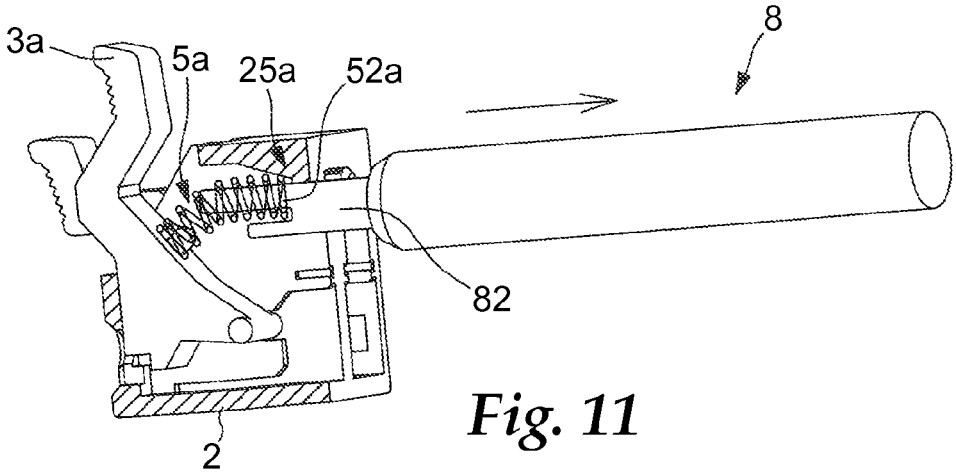
FIG. 11 A view showing the state that the jig is withdrawn so that the other end of the coil spring comes into contact with a spring supporting part of the housing.
Figure 12:
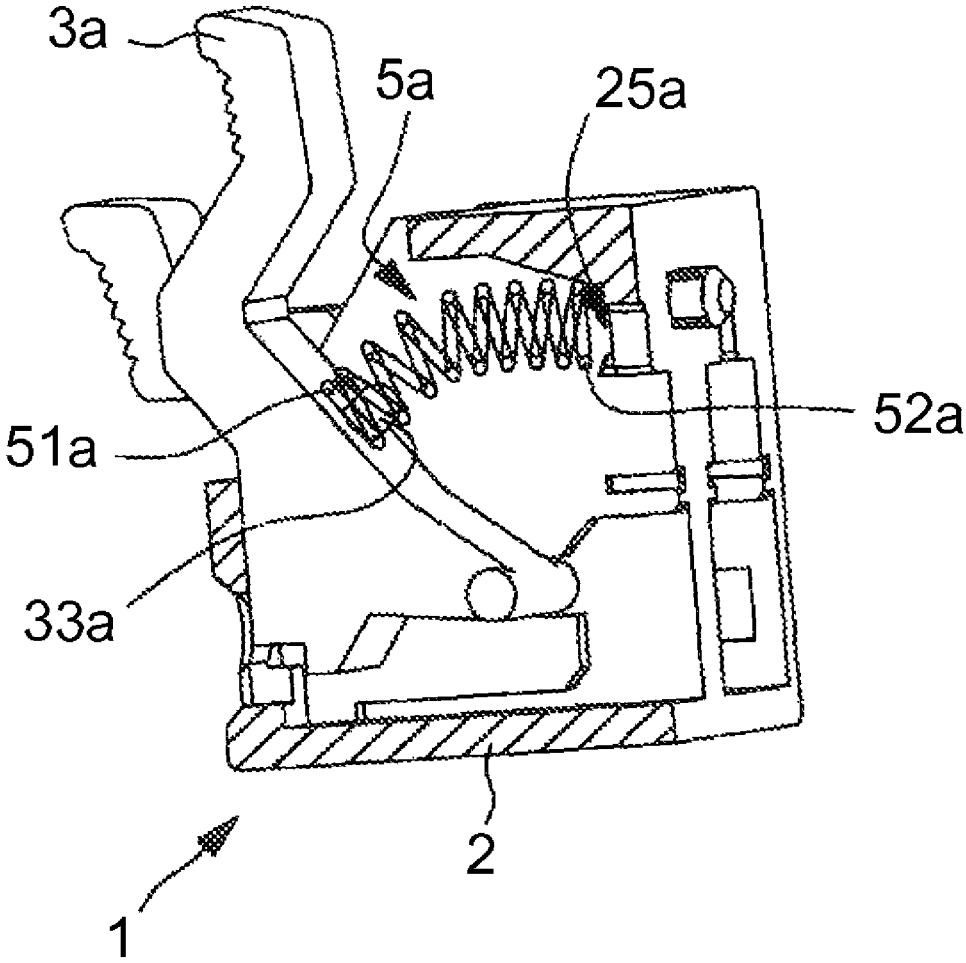
FIG. 12 A view showing the state that the mounting operation for the coil spring is completed.

Next to the state of FIG. 10, jig 8 is pulled from housing 2 so as to restore compressed coil spring 5*a*, as shown in FIG. 11. At this point, jig 8*a* is withdrawn so that holding part 82 of jig 8 passes through slit 27*a* of housing 2 in order that one end 52*a* of restored coil spring 5*a* comes into contact with supporting surface 251*a* of spring supporting part 25*a* (see FIG. 5). As described above, the width of slit 27*a* is larger than the width of holding part 82 and smaller than the outer diameter of the coil spring. Therefore, only jig 8 may be smoothly withdrawn by passing holding part 82 through slit 27*a*. Further, as shown in FIG. 5, since spring supporting part 25*a* has spring end holding portion 252*a* adjacent to the periphery of coil spring 5*a*, the position of coil spring 5*a* after it is supported by supporting part 25*a* is prevented from offsetting.

Due to the explained procedure, coil spring 5*a* may be assembled in a predetermined state: i.e., one end 51*a* of the coil spring engages protrusion 33*a* of lever member 3*a* and the other end 52*a* of the coil spring engages spring supporting part 25*a* of housing 2. When coil spring should be detached from housing 2, the procedure as explained in FIGS. 7 to 11 should be executed in reverse order.

Figure 13:
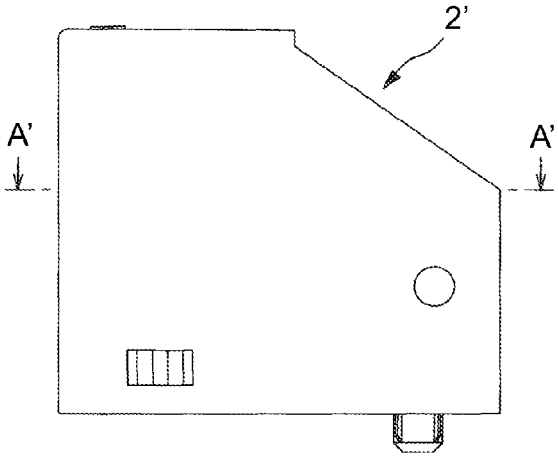
FIGS. 13-13B FIG. 13 is a side view.
Figure 13A:
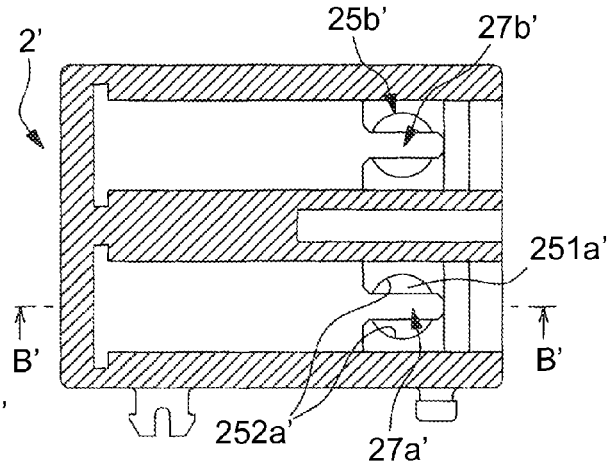
FIG. 13A is a cross sectional view along A-A line of the side view.
Figure 13B:
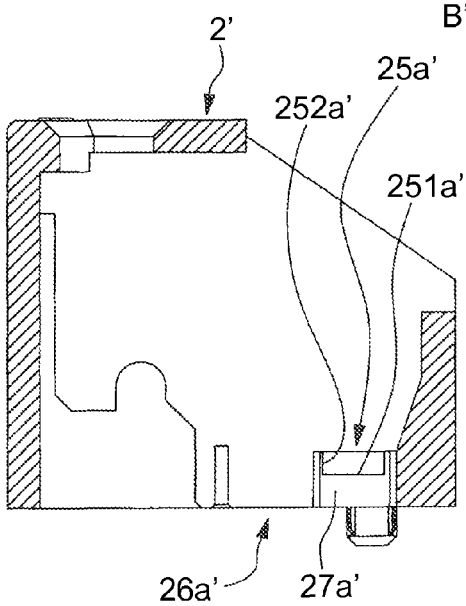

FIGS. 13, 13A, and 13B show another embodiment of the spring supporting part formed in the housing. FIGS. 13, 13A, and 13B include a part drawing of a housing 2' and two cross sectional views thereof. A spring supporting part 25*a'* has a supporting surface 251*a'* which contacts one end 52*a* of coil spring 5*a* (FIG. 3), and a spring end holding portion 252*a'* which holds coil spring end 52*a* such that the end does not offset in the radial direction of the coil spring. For example, spring supporting part 25*a'* is a circular recess, having the diameter slightly larger than the outer diameter of the coil spring, formed near the bottom of housing 2'. In this case, supporting surface 251 *a'* and spring end holding portion 252*a'* correspond to bottom and side surfaces of the circular recess, respectively. A slit or a concave portion 27*a'*, communicated with an opening 26*a'* of housing 2', generally straightly extends in the circular recess. Also in this case, spring end holding portion 252*a'* generally vertically extends from supporting surface 251 *a'* and arranged at a part of the periphery of supporting surface 251 *a'* such that spring end holding portion 252*a'* does not block slit 27*a'*. The width of slit 27*a'* is smaller than the outer diameter of coil spring 5*a*. Although it is sufficient that the front end of slit 27*a'* reaches spring supporting surface 251 *a'*, the length of slit 27*a'* is preferably equal to or larger than the radius of coil spring 5*a*, in view of workability and/or the strength of the jig. Since spring supporting part 25*b'* and slit 27*b'* may be the same as spring supporting part 25*a'* and slit 27*a'*, respectively, the detailed explanation thereof is omitted.

In the illustrated embodiment, terminal block 1 has two connecting terminals, two lever members and two biasing members or coil springs. However, the terminal block may have one connecting terminal, one lever member and one coil spring, or, three or more connecting terminals, three or more lever members and three or more coil springs.

The invention claimed is:

1. A terminal block comprising:

a housing;

at least one lever member movably arranged on the housing;

at least one coil spring positioned in the housing, the at least one coil spring being configured to bias the at least one lever member in a certain direction;

a spring supporting part configured to support one end of the coil spring;

an opening formed in the housing for inserting the coil spring into the housing; and a slit communicated with the opening of the housing, the slit extending in at least a portion of the spring supporting part and having the width which is smaller than an outer diameter of the coil spring.

2. The terminal block according to claim 1, wherein the coil supporting part has a supporting surface which the one end of the coil spring contacts, and a spring end holding portion extending from the supporting surface and arranged at a part of the periphery of the supporting surface such that the spring end holding portion does not block the slit.

3. The terminal block according to claim 1, wherein the length of the slit is equal to or larger than the radius of the coil spring.

4. A method for assembling a terminal block, the method comprising the steps of:

providing a housing having at least one lever member movably arranged on the housing;

providing a jig having a holding member capable of holding one end of a coil spring which biases the at least one lever member in a certain direction in the housing;

engaging one end of the coil spring with the holding member of the jig;

inserting the coil spring into the housing through an opening formed in the housing;

engaging the other end of the coil spring with a portion of the lever member in the housing;

compressing the coil spring by pushing the jig into the housing;

moving the jig such that the holding member is positioned in a slit formed in the housing while the coil spring is compressed, the slit being communicated with the opening of the housing, the slit extending in at least a portion of a spring supporting part configured of the housing to support the one end of the coil spring, and having the width which is smaller than an outer diameter of the coil spring; and drawing out the jig from the housing while the holding member of the jig is positioned in the slit such that the one end of the coil spring contacts the spring supporting part of the housing.

* * * * *

UNITED STATES PATENT AND TRADEMARK OFFICE

CERTIFICATE OF CORRECTION

PATENT NO. : 8,210,865 B2
APPLICATION NO. : 13/132144
DATED : July 3, 2012
INVENTOR(S) : Tatsuya Hayashi It is certified that error appears in the above-identified patent and that said Letters Patent is hereby corrected as shown below:

Page 1, Column 1

Line 1 (title), delete "OF" and insert in place thereof -- FOR --.

Column 6

Lines 6-8, delete "Alternatively, lever member 3a may have a recess at the position of protrusion 33a, whereby the coil spring end may be inserted in to the recess." and insert the same on Column 6, Line 5, after "protrusion." as a continuation of the same paragraph.

Line 51, delete "251 a" and insert in place thereof -- 251a' --.

Signed and Sealed this
Eleventh Day of September, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,210,865 B2
APPLICATION NO. : 13/132144
DATED : July 3, 2012
INVENTOR(S) : Tatsuya Hayashi It is certified that error appears in the above-identified patent and that said Letters Patent is hereby corrected as shown below:

Title Page, Item (54) and at Column 1, Line 1
(Title), delete "OF" and insert in place thereof -- FOR --.

Column 6
Lines 6-8, delete "Alternatively, lever member 3a may have a recess at the position of protrusion 33a, whereby the coil spring end may be inserted in to the recess." and insert the same on Column 6, Line 5, after "protrusion." as a continuation of the same paragraph.

Line 51, delete "251 a" and insert in place thereof -- 251a' --.

This certificate supersedes the Certificate of Correction issued September 11, 2012.

Signed and Sealed this
Ninth Day of October, 2012

David J. Kappos

David J. Kappos
*Director of the United States Patent and Trademark Office*